US006502959B2

(12) United States Patent
Lin

(10) Patent No.: US 6,502,959 B2
(45) Date of Patent: Jan. 7, 2003

(54) ILLUMINATION DEVICE USED IN A COMPACT DISK RECEIVING FRAME

(76) Inventor: Jack Lin, P.O. Box 26-757, Taipei (TW)

( * ) Notice: Subject to any disclaimer, the term of this patent is extended or adjusted under 35 U.S.C. 154(b) by 0 days.

(21) Appl. No.: 09/803,118

(22) Filed: Mar. 7, 2001

(65) Prior Publication Data

US 2002/0126474 A1 Sep. 12, 2002

(51) Int. Cl.[7] ..... F21W 131/30

(52) U.S. Cl. ..... 362/253; 362/127; 362/133; 362/270; 362/371; 362/413

(58) Field of Search ..... 362/132, 133, 362/127, 134, 154, 253, 125, 234, 249, 269, 270, 275, 371, 413

(56) References Cited

U.S. PATENT DOCUMENTS 656,211 A * 8/1900 Porter ..... 362/270
5,012,394 A * 4/1991 Woodward ..... 362/413
5,265,000 A * 11/1993 Lin ..... 362/413
5,584,398 A * 12/1996 Lin ..... 362/253
5,695,271 A * 12/1997 Zeller ..... 362/413
5,961,200 A * 10/1999 Friis ..... 362/133
6,113,250 A * 9/2000 Lin ..... 362/413

* cited by examiner

*Primary Examiner*—Laura K. Tso
(74) *Attorney, Agent, or Firm*—Rosenberg, Klein & Lee

(57) ABSTRACT

An illumination device used in a compact disk receiving frame is disclosed. The illumination device includes a body. An electric wire is installed within the body. Another end of the electric wire is connected to a pressable switch. Each of two sides of the pressable switch is installed with a telescopic rod. A plate is installed between the two rod bodies. The plate serves, to prevent a short circuit due to contact of the two rod bodies. One end of each of die two rod bodies is connected to a lampshade. A bulb is installed in the lampshade. Thus, this illumination device is placed in the CD receiving frame to achieve the effect of illumination. Moreover, the user may read the data in the compact disks within the CD receiving frame conveniently.

10 Claims, 7 Drawing Sheets

ILLUMINATION DEVICE USED IN A COMPACT DISK RECEIVING FRAME

FIELD OF THE INVENTION

The present invention relates to an illumination device, and especially to an illumination device used in a CD (compact disk) receiving frame and thus, data (such as catalog or lyrics) on the compact disk can be read easily so that it is practical and convenient to the users.

BACKGROUND OF THE INVENTION

Referring to FIG. 1, the structure of a prior CD receiving frame is illustrated. The structure has a receiving frame 10 which has an oblong shape. Two sides of the receiving frame 10 is installed with a plurality of spacers 11 corresponding to one another and spaced equally. The spacers 11 may be arrange with a plurality of compact disks (not shown). In order that various data (e.g., data or lyrics) on the compact disk can be read easily, a lamp 12 is placed at the top of the receiving frame 10. The lamp 12 has a seat 121. The seat 121 is installed with a switch 122. The switch 122 may open or close the illumination device of the lamp 12. The seat 121 is extended with an electric wire 123. One end of the electric wire 123 may be inserted with a receptacle (not shown) for supplying power required by the lamp 12.

However, since the volume of the compact disc is not too large and the receiving frame 10 may be arranged with a plurality of compact disks, the compact disks are stacked one by one. In order that the compact disks do not fall the width of the receiving frame 10 is approximately equal to the width of the compact disks so that the users may read all data (for example catalogs or lyrics) in a compact disks. The user may turn on the lamp indoors or a lamp 12 at the top of the receiving frame 10. The width of the receiving frame 10 is limited, while the cat 121 of the lamp 12 is generally larger than the top of the receiving frame 10. The illumination effect is not preferred or one conforming the lamp 12 at the top of the receiving frame.

Further, since the lamp 12 is arranged at the top of the receiving frame 10, the lamp 12 has no effect of fixing. For example, if the user touches the receiving frame 10 or the lamp 12 carelessly, the lamp 12 will drop down from the receiving frame 10. Thus, a new lamp 12 is necessary so as to increase the burden of the user. Furthermore, since the electric wire 123 extending from the lamp 12 is exposed out of the receiving frame 10, it is possible that the user will stumble over the electric wire by accident.

SUMMARY OF THE INVENTION

Accordingly, the primary object of the present invention is to provide an illumination device used in a compact disk receiving frame, wherein the illumination device is integrally combined with the CD receiving frame. Thus, it is not necessary to open the indoor lamp for reading data (such as catalogs or lyrics) in the compact disks. Therefore, power is saved effectively. Additionally, if the user touches the receiving frame or the lamp carelessly, the lamp will not drop from the receiving frame and no new lamp is required to decrease the burden of the user.

To achieve the objective, the present invention provides an illumination device used in a compact disk receiving frame. The illumination device includes a body. An electric wire is connected to a body and a pressable switch. Each of two sides of the pressable switch is installed with telescopic rod bodies, with a plate installed between the two rod bodies.

The plate serves to prevent a short circuit due to contact of the two rod bodies. One end of each of the two rod bodies is connected to a lampshade. A bulb is installed in the lampshade. Thereby, this illumination device is placed in the CD receiving frame so as to achieve the effect of illumination. Moreover, the user may read the data in the compact disks within the CD receiving frame conveniently.

In order that those skilled in the art can further understand the present invention, a detailed description will be described in the following paragraphs. However, these descriptions and the appended drawings are only used to assist those skilled in the art to understand the objects, features, and characteristics of the present invention, and not used to confine the scope and spirit of the present invention defined in the appended claims.

The various objects and advantages of the present invention will be more readily understood from the following detailed description when read in conjunction with the appended drawing.

DETAILED DESCRIPTION OF THE PREFERRED EMBODIMENTS

Figure 1:
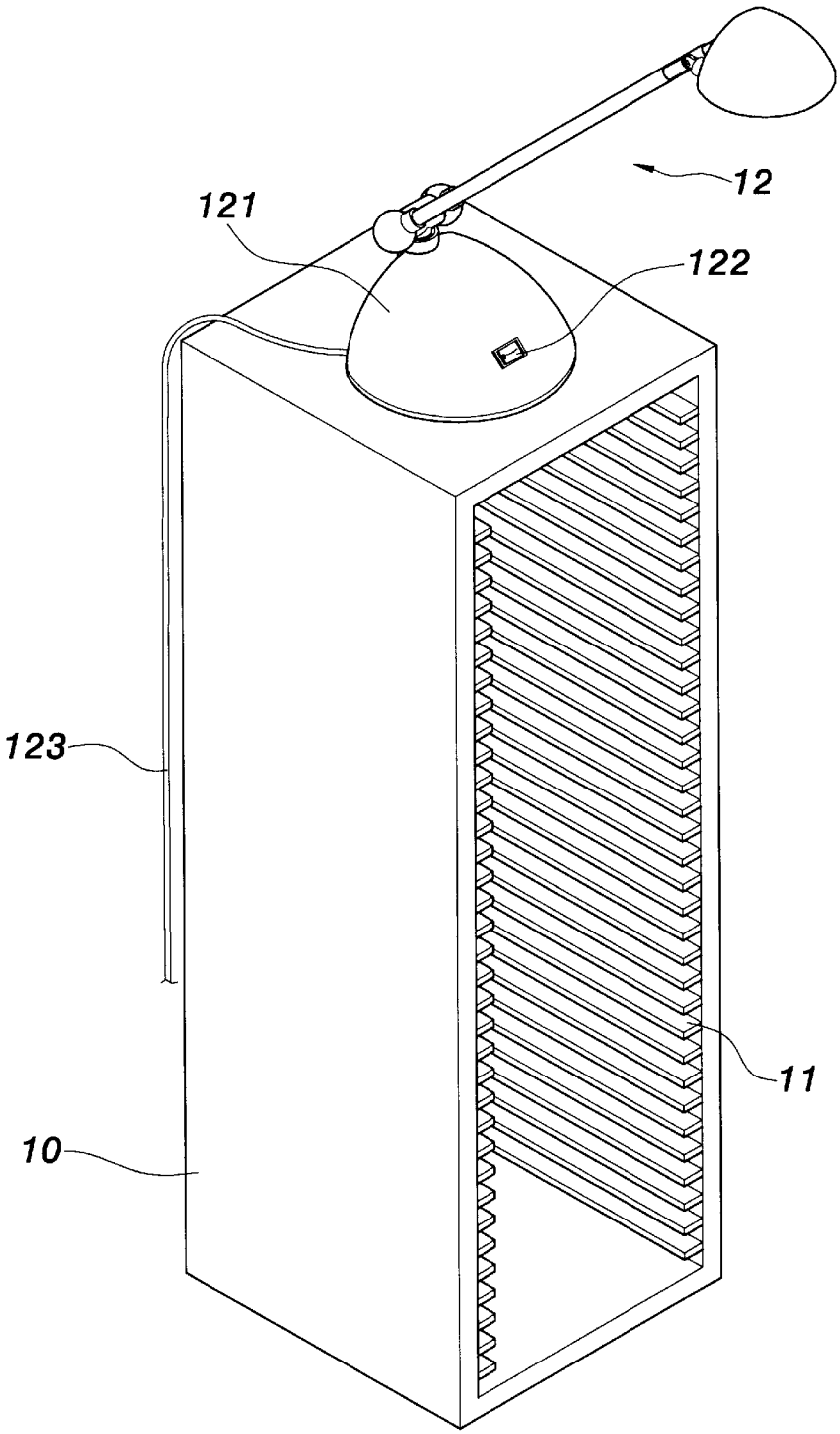
FIG. 1 PRIOR ART
FIG. 1 is a perspective view of the compact disk receiving frame an lamp of the prior art.
Figure 2:
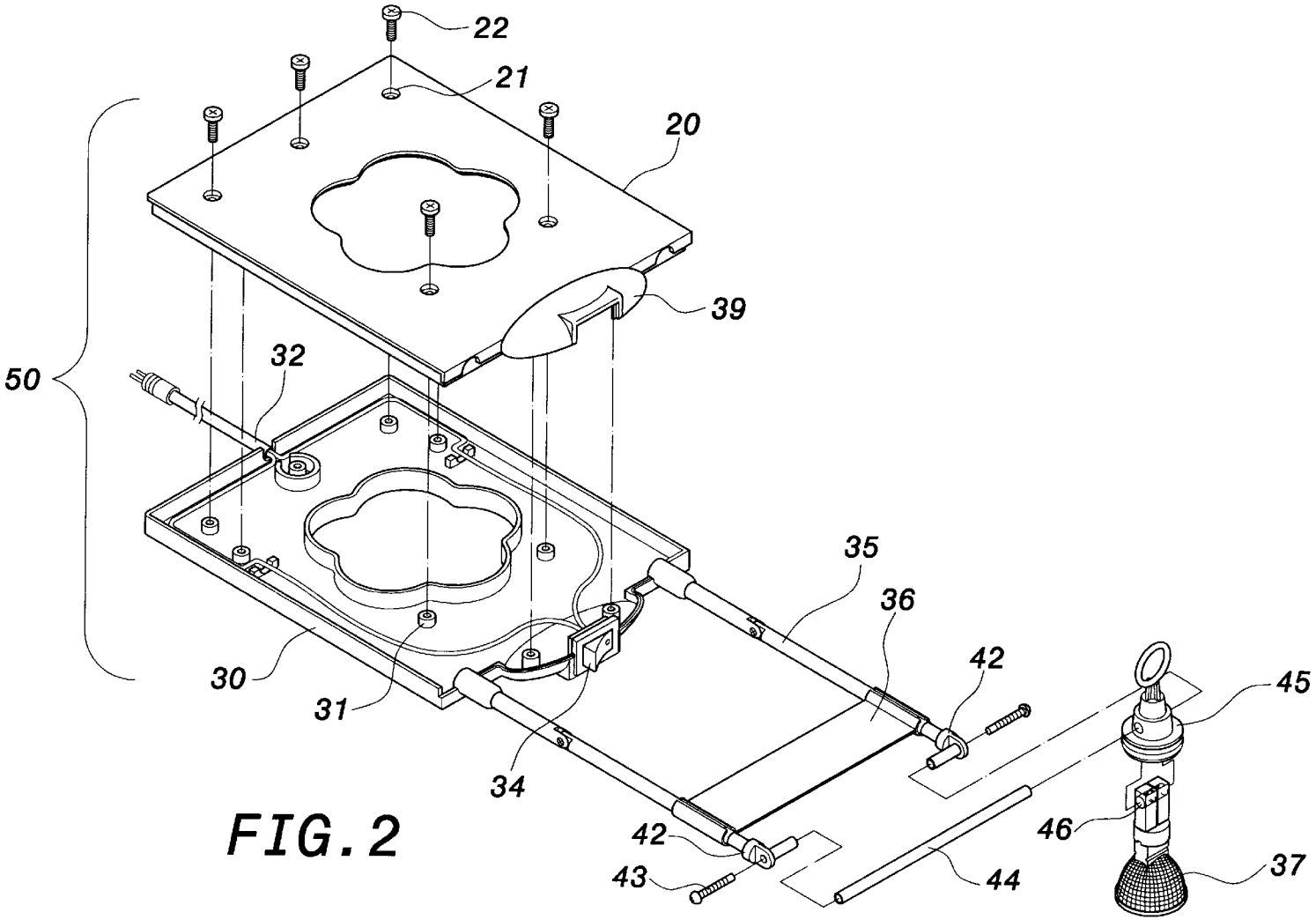
FIG. 2 is an exploded perspective view of the illumination device of the present invention.
Figure 3:
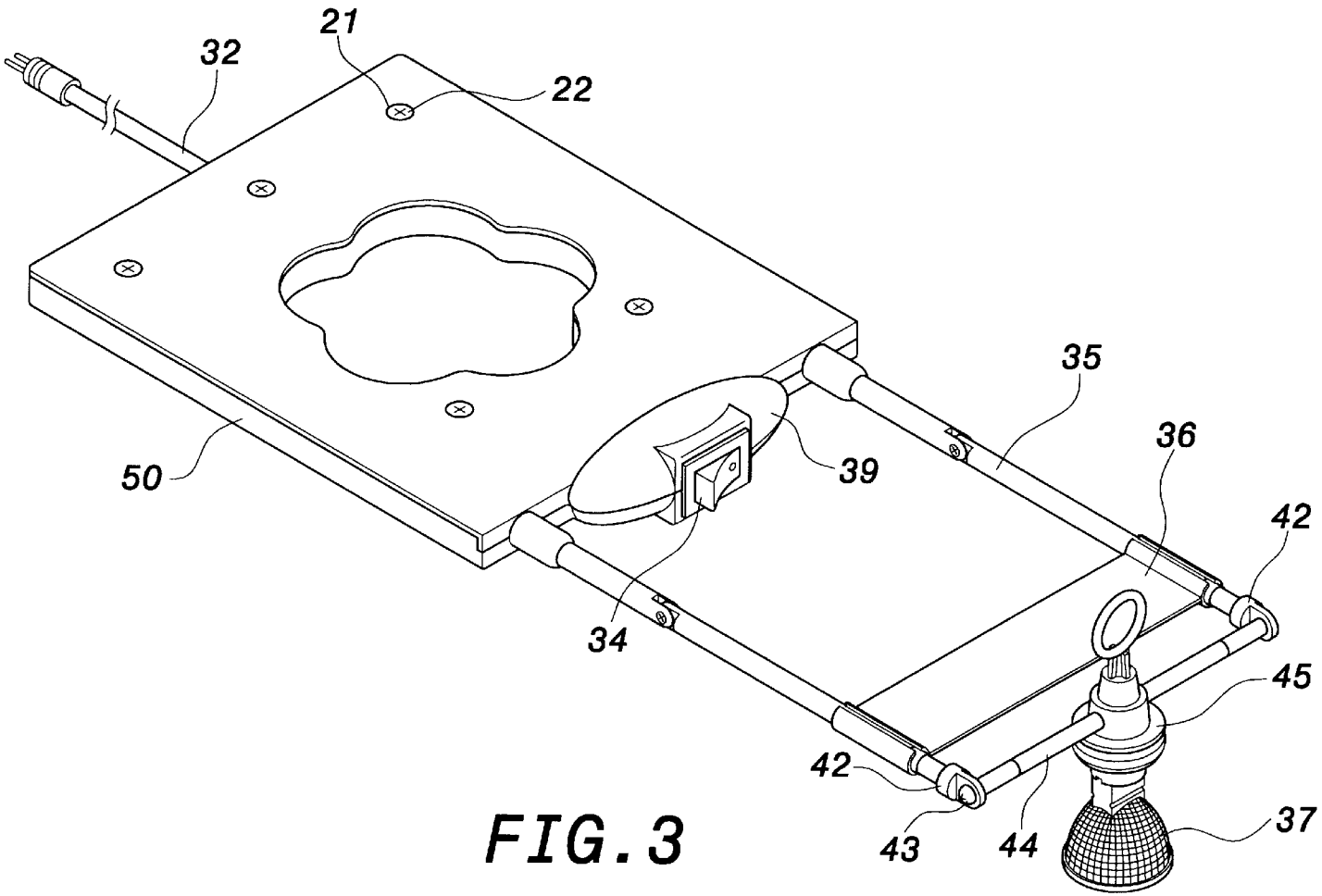
FIG. 3 is an assembled perspective view of the illumination device according to the present invention.

Referring to FIGS. 2 and 3, an illumination device is provided in the present invention, which is especially placed in the compact disk (CD) receiving frame. The present invention includes an upper cover 20 which is hollowed and has a shape like a plum blossom. Each edge of the upper cover 20 is installed with a plurality of holes 21. Each hole 21 is inserted by a screw 22. The screw 22 may be connected with a box 30. A body is formed by screwing the upper cover 20 the box 30. A plurality of cylinders 31 are installed within the box 30. Each cylinder 31 may be screwed and then locked by a screw 22. An electric wire 32 is hidden in the body 50. A rear side of the body 50 is installed with a notch 33, the notch 33 may be inserted by an electric wire 32 conveniently.

A front side of the body 50 is installed with a cover 39. The cover 39 may be connected to a pressable switch 34. One end of the electric wire 32 is connected to the switch 34 and another end of the electric wire 32 is connected to a receptacle (not shown). Two sides of the switch 34 are installed with two rod bodies 35 which arc telescopic and pivotable. The two rod bodies 35 may be antennas or soft tubes. A plate 36 is installed between the two rod bodies 35. The plate 36 serves to prevent the two rod bodies 35 from contacting each other, and thus causing a short-circuit. The distal end of each tie rod bodies 35 is connected to a locking device 42. The locking device 42 serves to lock a rod body 44 with a lock 43. The rod body 44 is inserted by a tapered combiner 45. The combiner 45 is enclosed by a lampshade 37. A bulb (not shown) is mounted within the lampshade 37.

The bulb may be fluorescent lamp or a halogen lamp, and other convenient devices. One end of the lampshade 37 is installed with a round hole 46. The round hole 46 serves to be inserted by the rod body 44 so that the lampshade 37 is substantially connected to the combiner 45.

Figure 4:
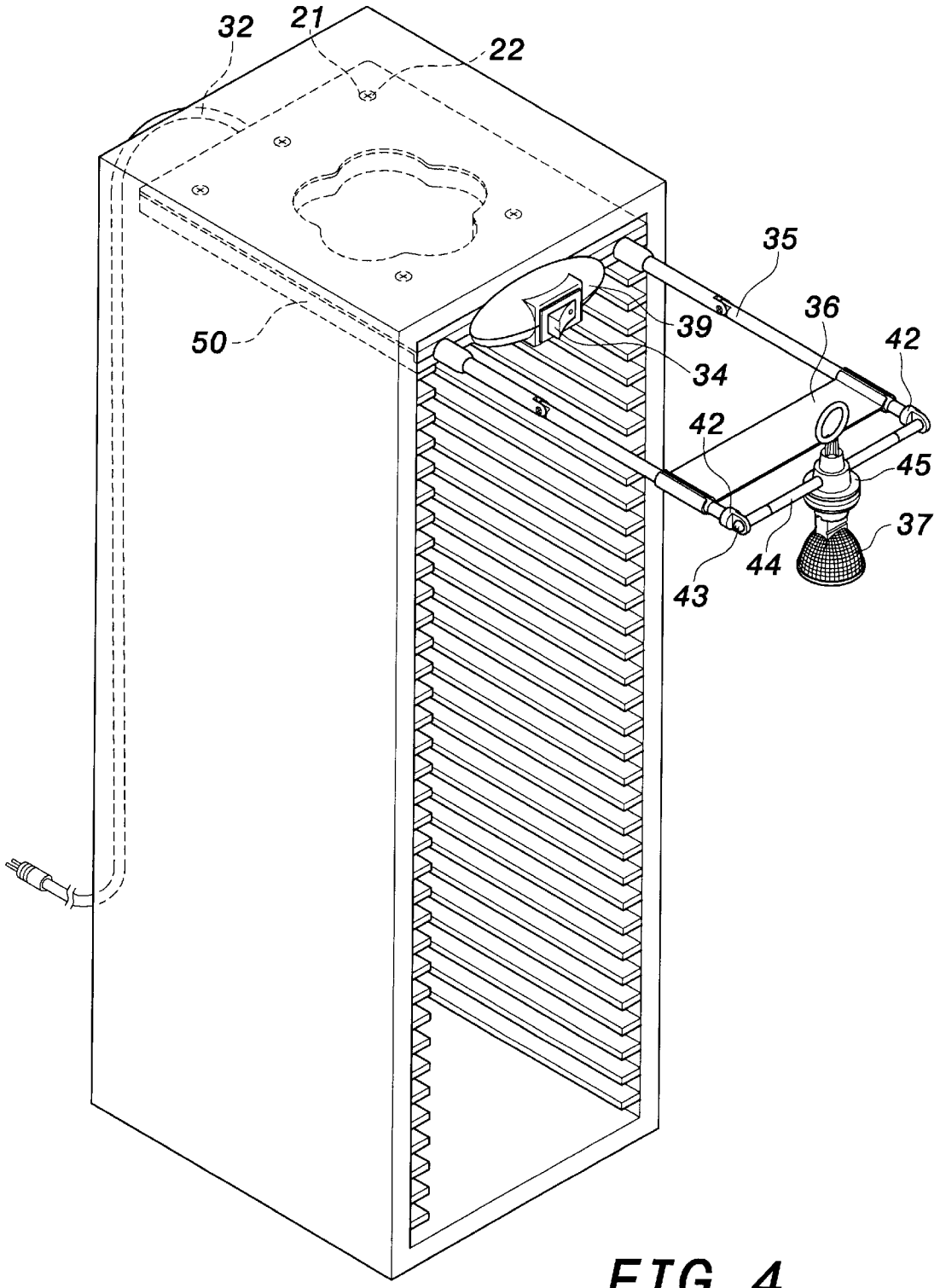
FIG. 4 is a perspective view of the present invention.
Figure 5:
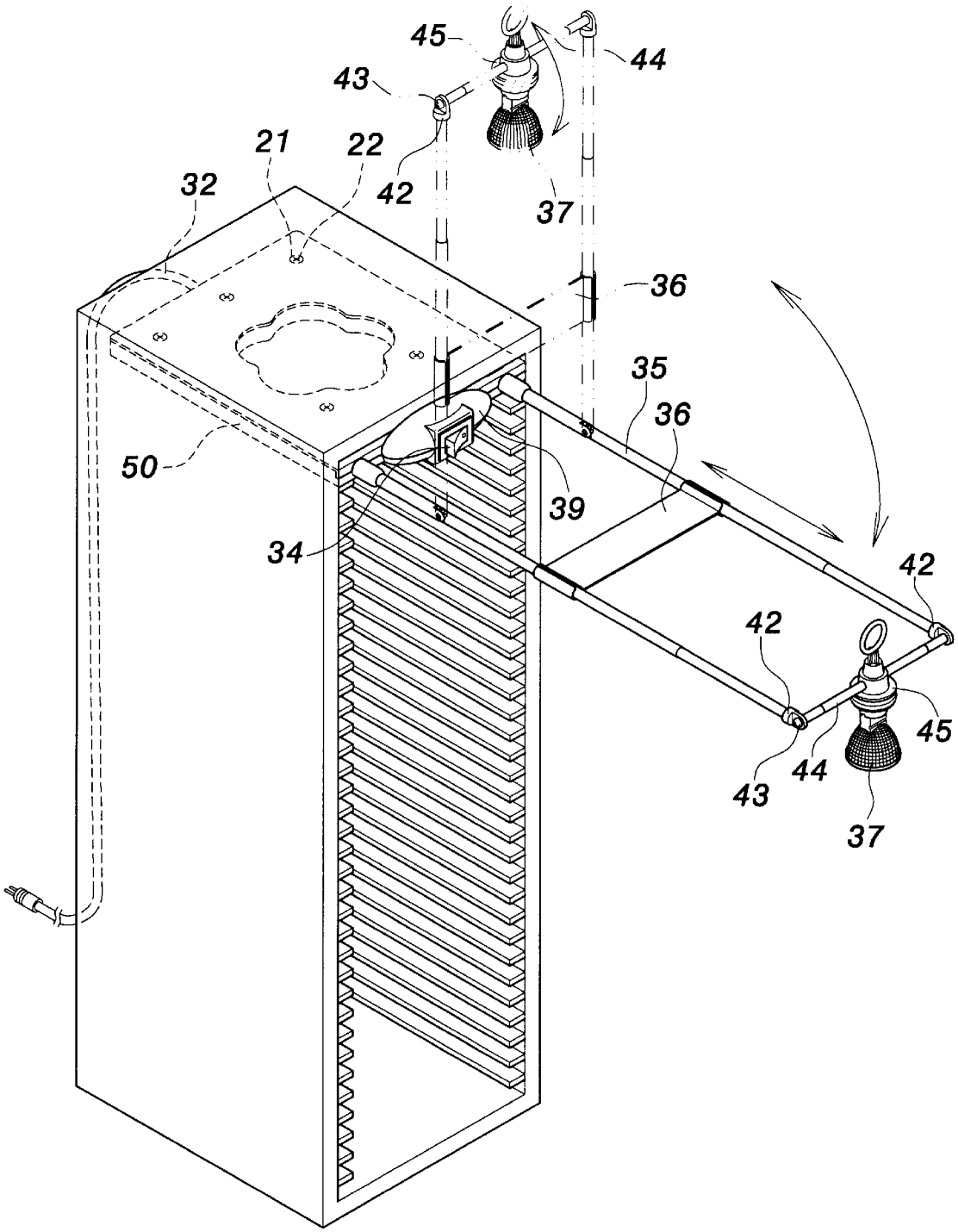
FIG. 5 shows an application of the present invention.

With reference to FIGS. 3, 4 and 5, the body 50 is firmly secured to the top of the CD receiving frame 40. Two sides of the CD receiving frame 40 are installed with a plurality of spacers 41 which are positioned with respect to each other, and are spaced with an equal space. The spacers 41 can be arranged with a plurality of compact disks (not shown). The electric wire 32 is hidden in the inner rear side of the CD receiving frame 40. In order to prevent the user from stumbling, the two telescopic and bendable rod bodies 35 protrude from the front edge of the top of the CD receiving frame 40. Thus, the user may adjust the orientation of the lampshade 37 conveniently and read the data (for example lyrics, etc.) In the compact disks within the CD receiving frame 40. Therefore, the user may use it conveniently.

Figure 6:
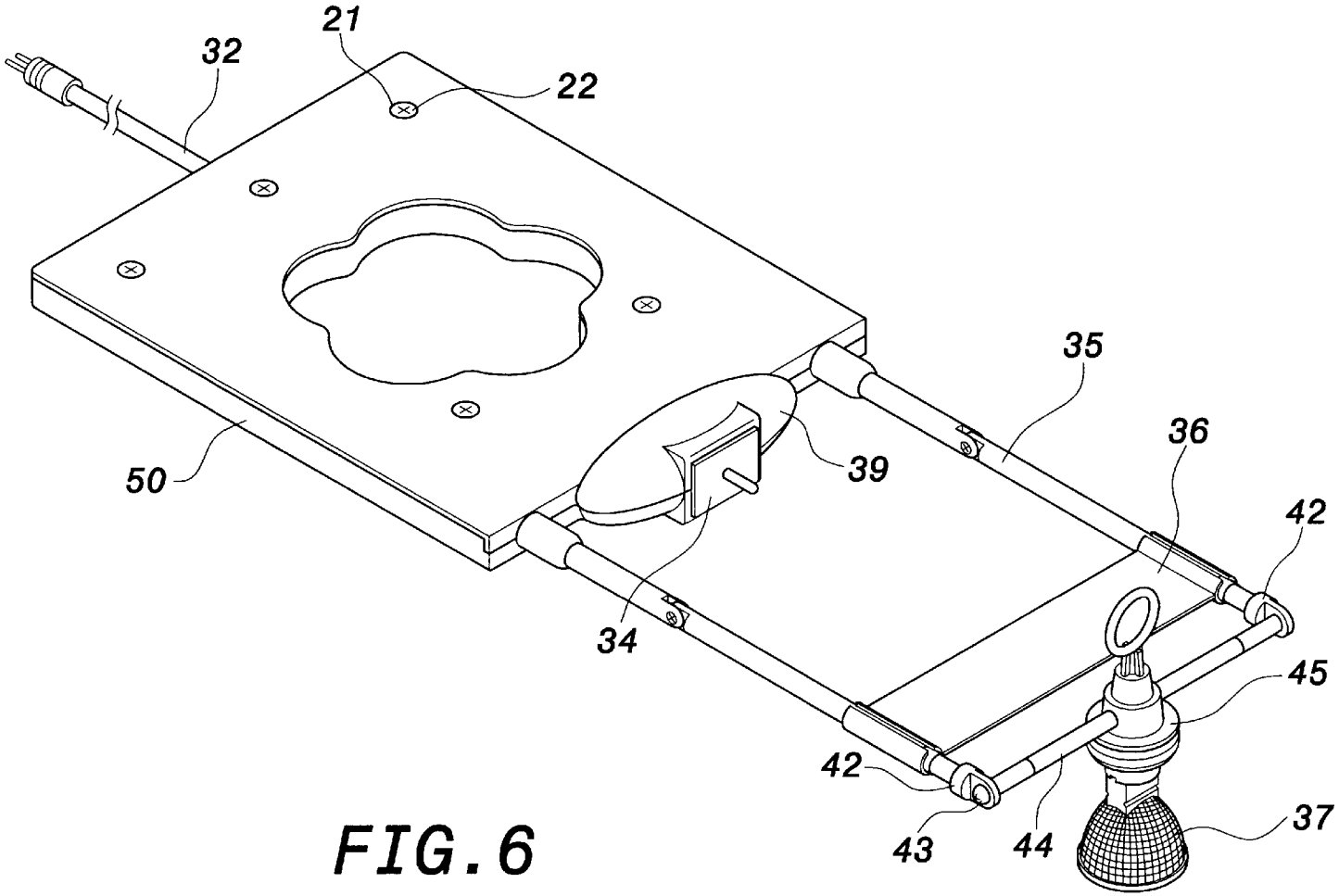
FIG. 6 is a perspective view of the pressable switch in another embodiment of the present invention.

Referring to FIG. 6, another embodiment of the present invention is illustrated. In order to diversify the present invention, a rod type switch 122 can be used to replace the pressable switch 34. The mounting and connection of the switch 34 is identical to the aforesaid embodiment.

Figure 7:
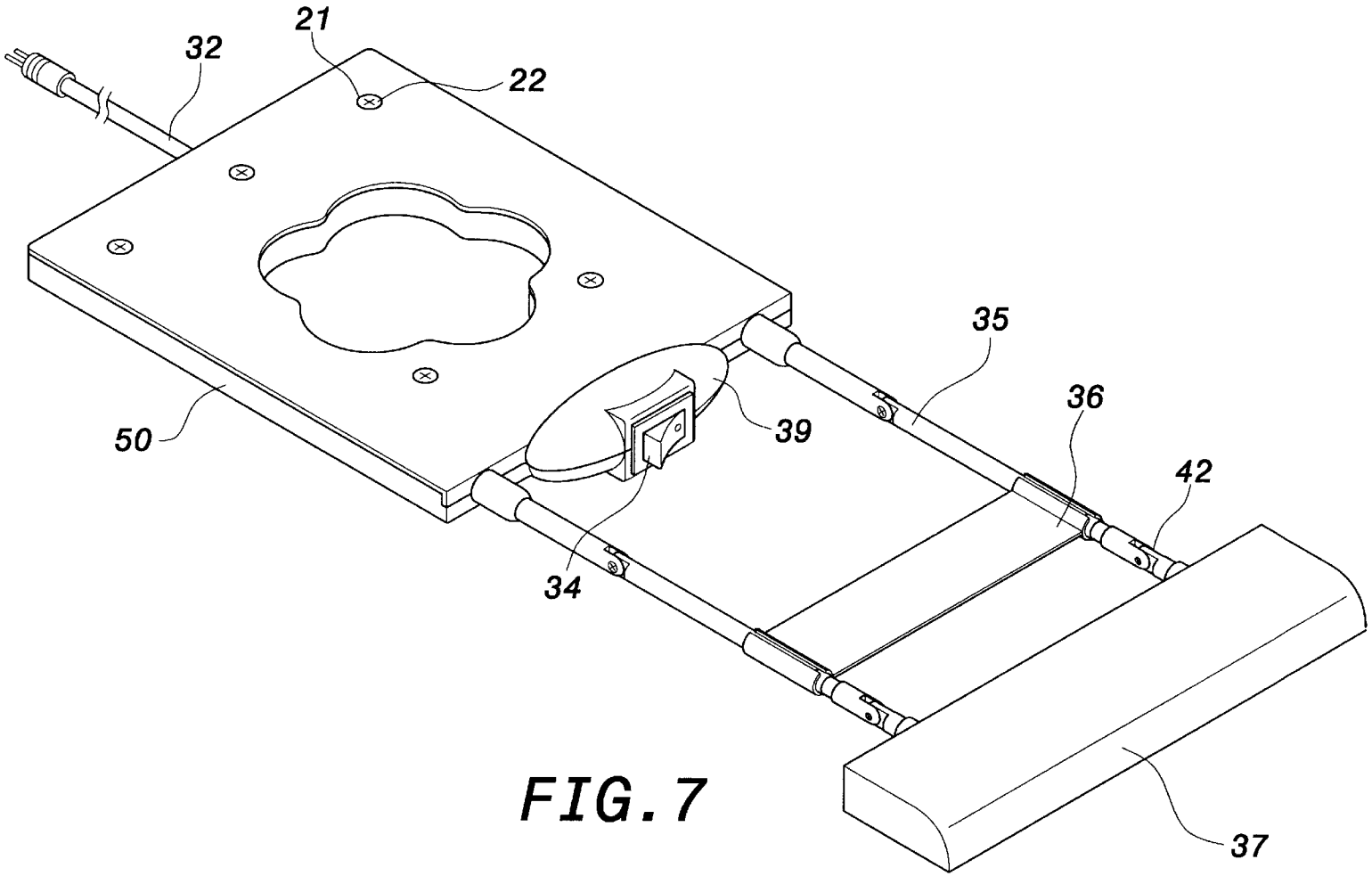
FIG. 7 is a perspective view showing a modification of the lampshade in a further embodiment in the present invention.

Referring to FIG. 7, another embodiment of the present invention is illustrated. In this embodiment, the lampshade 37 may be designed to have an oblong shape. Additionally, the lampshade 37 may have square shapes, oblong shapes, polygonal shapes, round shapes, elliptical shapes, triangular shapes, tetragonal shapes, etc.

Although the present invention has been described with reference to the preferred embodiments, it will be understood that the invention is not limited to the details described thereof. Various substitutions and modifications have been suggested in the foregoing description, and other will occur to those of ordinary skill in the art. Therefore, all such substitutions and modifications are intended to be embraced within the scope of the invention as defined in the appended claims.

What is claimed is:

1. An illumination device, comprising:

a body being housed in a compact disk receiving frame, said body having two opposing sides supported by respective spacers of the compact disk receiving frame, said body having a front side and a pressable switch disposed in said front side;

an electric wire being contained in said body and coupled to said pressable switch;

a pair of pivotal rod bodies respectively disposed on two opposing sides of said pressable switch, each of said pivotal rod bodies being telescopic; and, a lampshade housing a bulb being coupled to distal ends of said pair of pivotal rod bodies.

2. The illumination device as claimed in claim 1, wherein said body is formed by an upper cover being mounted to a box by screws.

3. The illumination device as claimed in claim 1, wherein said body is a hollow body.

4. The illumination device as claimed in claim 1, wherein said pressable switch is one of a button switch or a plate type switch.

5. The illumination device as claimed in claim 1, wherein said lampshade has a shape selected from the group consisting of a square shape, oblong shape, polygonal shape, round shape, elliptical shape, triangular shape and tetragonal shape.

6. The illumination device as claimed in claim 1, wherein said bulb is selected from the group consisting of a fluorescent bulb and a halogen bulb.

7. The illumination device as claimed in claim 1, wherein said pivotal rod bodies are selected from the group consisting of an antenna rod and a soft rod.

8. The illumination device as claimed in claim 1, wherein a plate is coupled between said pair of pivotal rod bodies to maintain a separation between said pivotal rod bodies.

9. The illumination device as claimed in claim 1, wherein said distal ends of said pivotal rod bodies are connected to a locking device, said locking device being locked by a lock and covered by said lampshade.

10. An illumination device, comprising:

a body being housed in a compact disk receiving frame and supported by a pair of spacers, said body having a front side and a rear side, said front side having a pressable switch mounted therein;

an electric wire coupled to said pressable switch and passing through said body to an opening formed through said rear side of said body;

a pair of pivotal rod bodies respectively disposed on two opposing sides of said pressable switch, each of said pivotal rod bodies having a telescopic distal end;

a pair of locking devices respectively coupled to said distal ends of said pivotal rod bodies, said locking device being locked by a lock; and, a lampshade housing a lamp coupled to and enclosing said pair of locking devices.

* * * * *